US005170595A

United States Patent [19]

Wiand

[11] Patent Number: 5,170,595

[45] Date of Patent: Dec. 15, 1992

[54] PULL TAB FOR VELCRO BACKED MARBLE GRINDING PAD AND METHOD FOR REMOVAL

[76] Inventor: Ronald C. Wiand, 1494 Heatherwood Dr., Troy, Mich. 48098

[21] Appl. No.: 630,026

[22] Filed: Dec. 19, 1990

[51] Int. Cl.[5] ..... B24D 11/00

[52] U.S. Cl. ..... 51/394; 51/177; 51/401; 51/406; 51/407

[58] Field of Search ..... 51/174, 177, 394, 401, 51/406, 407

[56] References Cited

U.S. PATENT DOCUMENTS

| | | | |
|---|---|---|---|
| 1,896,253 | 2/1933 | Smith | 51/406 |
| 3,540,160 | 11/1970 | De Rose et al. | 51/394 |
| 4,078,340 | 3/1978 | Klecker et al. . | |
| 4,111,666 | 9/1978 | Kalbow . | |
| 4,756,042 | 7/1988 | Genovese et al. | 51/177 |
| 4,962,562 | 10/1990 | Englund et al. | 51/394 |
| 5,007,128 | 4/1991 | Englund et al. | 51/394 |

*Primary Examiner*—J. J. Swann

*Attorney, Agent, or Firm*—Harness, Dickey & Pierce

[57] ABSTRACT

An abrasive pad which may be removed from a tool without breaching the bond between the Velcro® fabric and the abrasive pad. A tab member is attached to the Velcro® fabric which allows a user to impart removal forces substantially on the Velcro® fabric.

9 Claims, 2 Drawing Sheets

PULL TAB FOR VELCRO BACKED MARBLE GRINDING PAD AND METHOD FOR REMOVAL

BACKGROUND OF THE INVENTION

The present invention relates to a Veloro ® backed abrasive pad. More speoifioally, the present invention relates to a Velcro ® backed abrasive pad which inoludes a tab portion for effectively removing the pad from the rotary tool without separating the Velcro ® backing from the pad.

In the marble and stone finishing industry, it has been common in recent years to utilize Velcro ® type fasteners for attaching abrasive pads to rotary tools utilized in the industry. Because of the pressures applied to these pads, during finishing of the marble or stone surfaces, the Velcro ® attachments tend to become more heavily embedded into one another than the Velcro ® is designed to accommodate. In the past, this has not generally been a problem since the pads utilized were generally torn up or otherwise expended by the time it was necessary to remove a pad from the rotary tool. Thus, destruction of a spent abrasive pad was not a problem in the past.

With the advent of new polymeric type pads or other pads, which can provide greatly increased wear over prior art pads, removal and reuse of the pad is common. Therefore, destruction of the pad during removal is undesirable. It has become a problem recently that because the Velcro ® is adhesively applied to the backs of such pads and because of the increased adhesion between the Velcro ® backing of the pad and the Velcro ® of the rotary tool, the pad sometimes separates from the Velcro ® backing during removal. This tends to ruin the pad at least for any continued normal use of the pad. Thus, while the pad has remaining useful life in its abrasive grit portion, the usefulness of the pad may be ruined if the adhesive between the backing of the pad and the Velcro ® material is breached during removal of the pad from the rotary tool.

Therefore, it has been a goal in the art to provide a useful method or apparatus of removing a Velcro ® backed pad from a rotary tool without breaching the adhesive bond between the pad and the Velcro ® backing.

SUMMARY OF THE INVENTION

In accordance with the present invention, this goal has been met by providing an abrasive pad which includes a pull tab portion for applying a force to the Velcro ® backing portion, rather than utilizing the pad itself, when attempting to remove the pad from the rotary tool. Thus, in accordance with the present invention there is provided a novel abrasive pad combination. The abrasive pad combination of the present invention includes an abrasive pad member having an outer periphery. The pad member includes an abrasive surface side and a back side. A first side of an interlocking type fastener fabric is attached to the back side of the pad for providing connection to a rotary tool. A removal means is provided in the present invention which may be gripped by a user for imposing removal forces substantially on the fastener fabric. Thus, the pad may be separated from the bond between the fastener fabric of the pad and the fastener fabric of the rotary tool without detrimentally affecting the attachment of the fastener fabric to the pad member.

Further advantages of the present invention will become known to those skilled in the art in light of the following drawings when considered with the description of the preferred embodiments and the claims set forth below.

DESCRIPTION OF THE PREFERRED EMBODIMENTS

Figure 1:
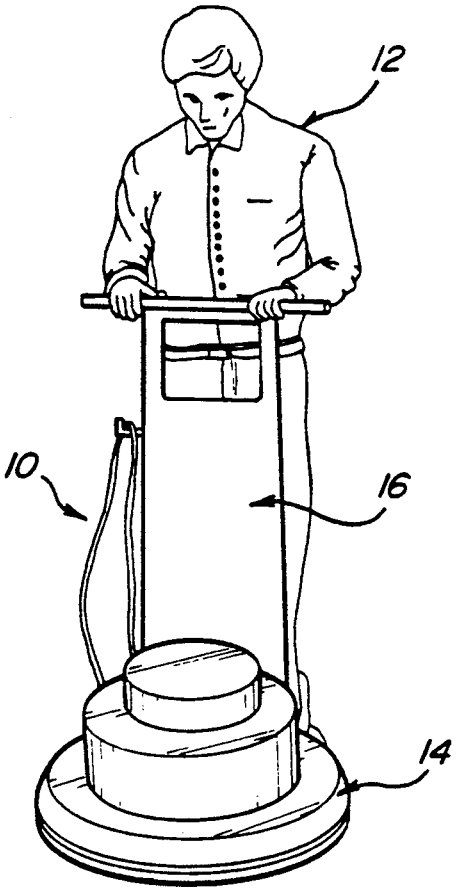
FIG. 1 is an overall perspective view of a floor sander type device wherein the present invention may be utilized.
Figure 2:
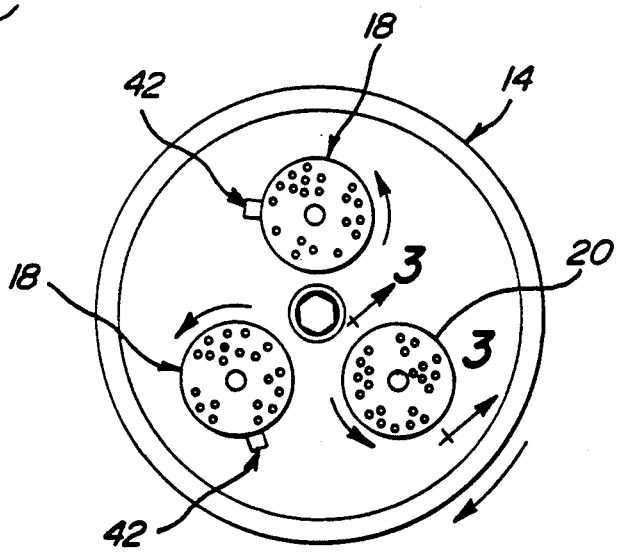
FIG. 2 is a detailed view of the polishing head of the device of FIG. 1.

Referring now to FIG. 1, there is shown a typical floor finishing apparatus 10 which is manually operated by an operator 12. The finishing apparatus 10 includes a sanding head portion 14 and a handle portion 16. Referring now to FIG. 2, the sanding head portion 14 may include three planetary heads 18 which rotate independently at a speed of from about 800 rpm to a speed not to exceed about 2,800 rpm. The entire sanding head portion 14 also rotates at about 170 rpm. Sanding apparatuses for stone or marble surfaces or the like generally operate at relatively low speeds which are about 2,800 rpm or less.

Figure 3:
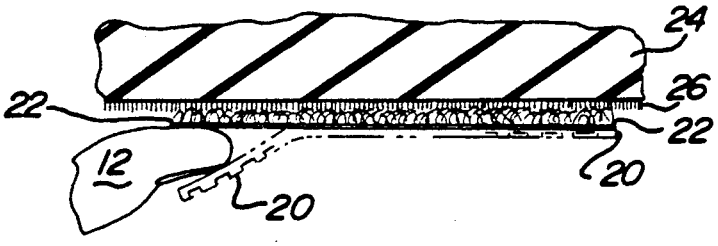
FIG. 3 is an illustrative view showing a typical prior art abrasive pad and the problem inherent therewith.

Referring now to FIG. 3, the prior art abrasive pads included an abrasive pad material 20 which includes a loop side Velcro ® fastener fabric 22 adhesively adhered thereto. The rotary tool includes a rubber type pad portion 24 with a hook side Velcro ® fastener fabric 26 attached thereto. Thus, by the interface between the loop side Velcro ® 22 of the pad 20 and the hook side Velcro ® 26 of the portion 24 the abrasive pad 20 is held onto the rotary tool. During the grinding operation of the marble, the pad is pushed into the rotary tool portion with large forces, attributable to the weight of the unit being placed on the pad. This tends to work the loop side Velcro ® 22 and hook side Velcro ® 26 together to form a bond which is well beyond the normal bonding specifications between such Velcro ® portions. This creates an enhanced separation resistent force which may be problematic upon replacement of a pad.

Referring now to FIG. 3, when separation is desired in order to change the prior art abrasive pad 20, for a new grit pad or the like, the operator 12 in the past has tended to grip the relatively stiff pad portion since this is the only available means to attempt to remove the pad 20 from the rotary tool. As shown in FIG. 3, it has been a problem in the past that when this is attempted the adhesive bond between the pad 20 and the loop side Velcro ® 22 is not sufficient to overcome the enhanced bond created between the loop side Velcro ® 22 and hook side Velcro ® 26. Because of this, the pad 20 may tend to separate from the loop side Velcro ® 22 rather than the loop side Velcro® 22 fabric separating from the hook side Velcro® 26 fabric of the rotary tool. This is shown in detail in FIG. 3. Thus, this problem has tended to reduce the life of otherwise useable abrasive pads. This problem is particularly evident in today's polymer pads, which utilize polypropylene or other polymer materials, since adhesives available for these materials have been found not to withstand the forces of removal.

Figure 5:
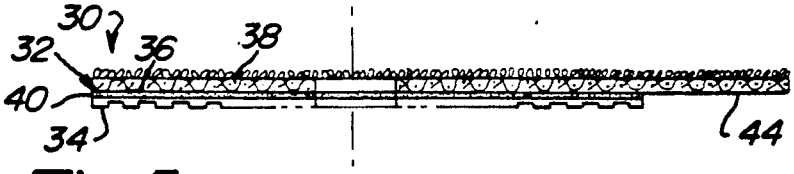
FIG. 5.is a sectional view of the pad of FIG. 4 taken along line 5—5 of FIG. 4.
Figure 4:
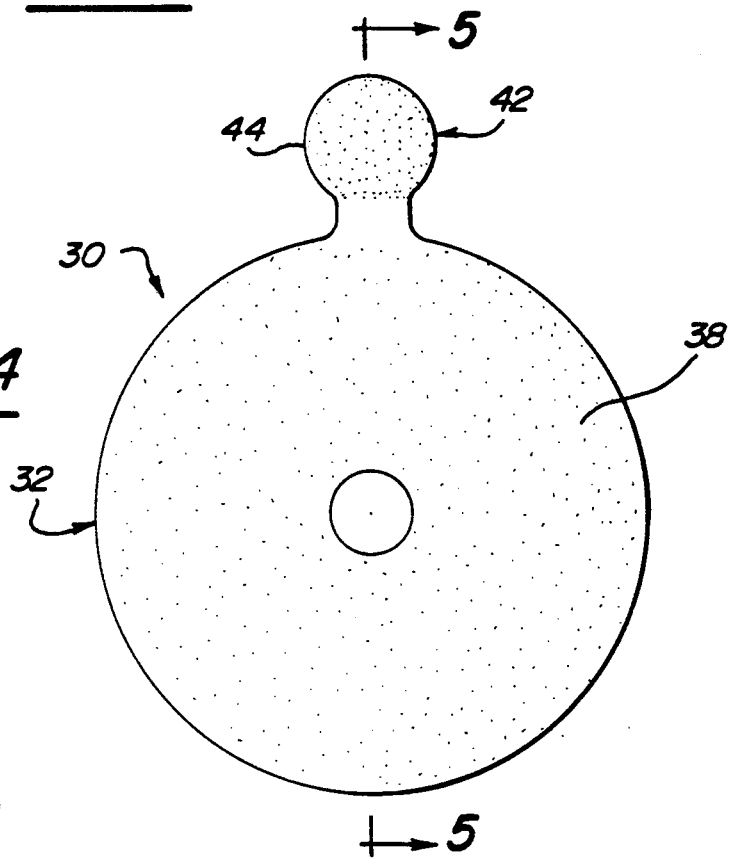
FIG. 4 is a back side view of an abrasive pad utilizing the teachings of the present invention.

Referring now to FIGS. 4 and 5 there is shown a first embodiment of an abrasive pad, generally indicated at 30, made in accordance with the teachings of the present invention. The abrasive pad 30 includes an outer periphery, generally indicated at 32. The abrasive pad 30 includes an abrasive side 34 and a back side 36. The abrasive pad in a preferred embodiment is a polypropylene abrasive pad having an abrasive grit material interspersed therethrough. Suitable abrasive pad structures wherein the present invention is particularly useful is set forth in my co-pending U.S. patent applications: Ser. No. 526,055, filed May 21, 1990, entitled "Flexible One-Piece Diamond Sheet Material With Spaced Apart Abrasive Portions"; and Ser. No. 557,955, filed Jul. 26, 1990, entitled "Flexible Abrasive Pad With Ramp Edge Surface", which are hereby incorporated herein by reference.

A Velcro® type hook or loop fastener fabric 38 is adhesively secured to the back side of the pad 36 by adhesive layer 40. In the broadest aspects of the present invention there is a removal means which may be gripped by a user, generally indicated at 42. The removal means 42 may be a bulbous tab 44 which is formed from he Velcro® fabric material itself which is attached to the abrasive pad 30. Thus, the tab 44 may be gripped by the user during removal, thereby imposing the removal forces substantially on the fastener fabric for removal of the pad from the tool without breaching the attachment of the fabric to the pad at the adhesive layer 40.

Figure 7:
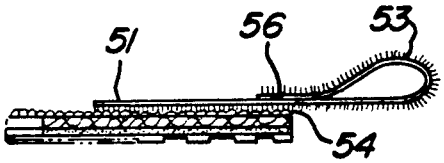
FIG. 7 is a sectional view of the pad of FIG. 6 taken along line 7—7 of FIG. 6.
Figure 6:
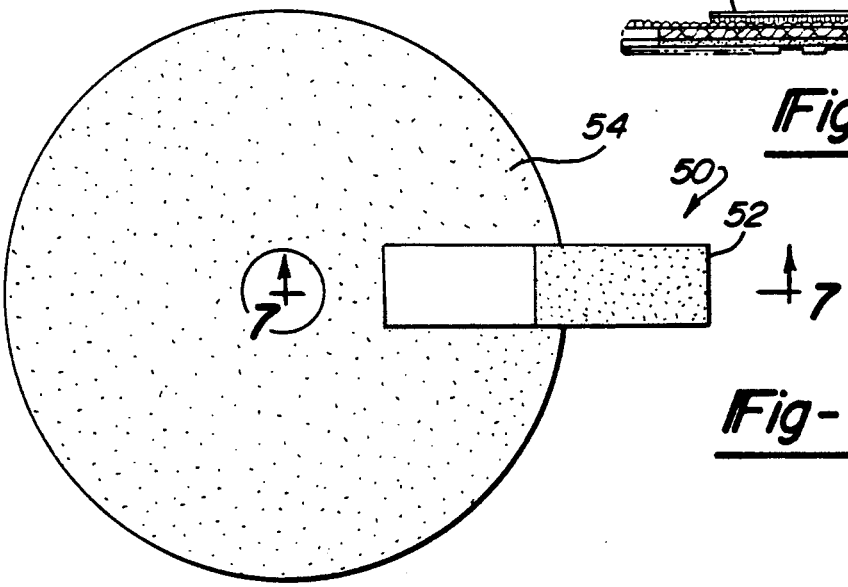
FIG. 6 is a back side view of an alternate embodiment of a pad made in accordance with the teachings of the present invention.

Referring now to FIGS. 6 and 7, there is shown an alternate embodiment of removal means of the present invention, generally shown at 50. In this embodiment the pad structure 48 is similar to that shown in FIGS. 4 and 5 with the exception that the tab portion 52 is a removable tab portion which is interposed between the Velcro® fabric backing 54 and the Velcro® fabric portion such as shown at 26 in FIG. 2 of the Velcro® rotary tool. In the preferred embodiment the rotary tool includes a hook type Velcró® (FIG. 3, numeral 26) and the fabric backing 54 is a loop type Velcro®. The tab portion 52 is shown in crosssection in FIG. 7. The rab portion 52 includes a first portion 51 for connection to the fastener fabric 54 and a second gripping portion 53 which extends from the outer periphery of the abrasive pad. The fastener fabric of the first portion 51 of the removabie tab portion 52 in a preferred embodiment is a hook type fabric fastener fabric strip which is doubled over on itself and is sewn together at portion 56. In operation, the hook type fabric portion 51 may be secured to the pad structure loop type Velcro® backgin 54 for interposing the first portion 51 of the tab 52 between the pad structure 48 and the fastener fabric of the rotary tool. As shown in FIG. 7, the hook type fabric of first portion 51 is fastened to loop type fabric 54 of the pad 48. Thereafter, the loop type backing 54 of the pad 48 is secured to the hook type portion of the tool 26 with the first portion 51 interposed therebetween. Thus, in this embodiment the tab 52 may be gripped at portion 53 by a user and forces of removal would be imposed on the Velcro® fabric backing portion 54 attached to the abrasive pad for allowing removal of the pad by imposing forces only on the Velcro® backing fabric portion 54.

Because, the pads used in the marble and stone finishing industry are operated at relatively low revolutions per minute (less than about 2,800 rpm), the structures disclosed above will not cause any unwanted vibrations due to the slight imbalance. Thus, the present invention is designed specifically for abrasive pads used in applications in which the pad is rotating at speeds of 2,800 rpm or less.

While hook and loop type fasteners are set forth in the preferred embodiment, the present invention may be practiced with other interlocking fastener fabric configurations such as ball and mushroom types or the like. Thus, the term fastener fabric in the claims shall refer to any of the various types of interlocking fastener fabrics which are operable for providing fastening of an abrasive pad to a rotary tool.

While the above disclosure sets forth preferred embodiments of the present invention, it will be readily appreciated by those skilled in the art that the present invention may be subject to modification, variation and change without departing from the scope of the present invention. Accordingly, it is intended that the scope of the present invention be limited only by the following claims.

What is claimed is:

1. A reusable abrasive pad for a rotary tool comprising:

an abrasive pad member which has an outer periphery, said abrasive pad member having an abrasive surface side and a backside;

a first portion of a fastener fabric attached to said backside, for providing connection to a rotary tool; and a removal means comprising a tab member extending from said outer periphery of said abrasive pad member which may be gripped by a user for imposing removal forces substantially on the fastener fabric for removal of the pad from the tool without breaching the attachment of the fabric to the pad.

2. The abrasive pad of claim 1 wherein said tab member is formed out of the fastener fabric.

3. The abrasive pad of claim 1 wherein said tab member further comprises a removable tab member which has a fastener means which is compatible for interlocking to said first portion of a fastener fabric attached 4. The abrasive pad of claim 1 wherein the fastener fabric is a hook or loop side of a Velcro® fastener fabric.

5. A resuable abrasive pad for a rotating tool comprising:

an abrasive pad member including an outer periphery and having an abrasive side and a backside;

a Velcro® type hook or loop fastener fabric attached to the back side for providing connection to a rotary tool; and a tab portion attached to said Velcro® type hook or loop fastener fabric and extending from said outer periphery whereby said tab portion is accessible for removing said pad from the rotary tool by transmitting the removal forces to the fastener fabric such that the integrity of the band between the fastener fabric and the pad member can be maintained.

6. The abrasive pad of claim 5 wherein said tab portion further comprises a removable tab member having a first portion for connection of the tab member to the fastener fabric and a gripping portion for gripping of the tab member by an operator.

7. The abrasive pad of claim 6 wherein said fastener fabric is a loop side fabric and said first portion is a compatible hook type fastener.

8. The abrasive pad of claim 5 wherein said fastener fabric is a loop side fabric and said first portion is a compatible hook type fastener.

9. The abrasive pad of claim 5 wherein said tab member is integrally formed of said hook or loop side fastener fabric attached to said backside of said abrasive pad member.

* * * * *

UNITED STATES PATENT AND TRADEMARK OFFICE

CERTIFICATE OF CORRECTION

PATENT NO. : 5,170,595

DATED : December 15, 1992

INVENTOR(S) : Ronald C. Wiand

It is certified that error appears in the above-identified patent and that said Letters Patent is hereby corrected as shown below:

Column 1, line 7, "speoifioally" should be -- specifically --

Column 1, line 8, "inoludes" should be -- includes --

Column 3, line 33, "he" should be -- the --

Column 3, line 47, "FIG.2" should be -- FIG. 3 --

Column 3, line 52, "rab" should be -- tab --

Column 3, line 56, "removabie" should be -- removable --

Column 3, line 60, "backgin" should be -- backing --

UNITED STATES PATENT AND TRADEMARK OFFICE
CERTIFICATE OF CORRECTION

PATENT NO. : 5,170,595

DATED : December 15, 1992

INVENTOR(S) : Ronald C. Wiand

It is certified that error appears in the above-identified patent and that said Letters Patent is hereby corrected as shown below:

Column 4,line 50, claim 3, after "attached" insert --to said backside of said abrasive pad member.--

Column 4, line 54, claim 5, "rotating" should be --rotary--.

Signed and Sealed this

Sixteenth Day of November, 1993

*Attest:*

*Attesting Officer*

Bruce Lehman

BRUCE LEHMAN

*Commissioner of Patents and Trademarks*